US010934717B2

(12) United States Patent
Atzen et al.

(10) Patent No.: US 10,934,717 B2
(45) Date of Patent: Mar. 2, 2021

(54) UNDERROOF COLLAR FOR USE IN WATER-PROOFING THE JOINT BETWEEN A ROOF STRUCTURE AND A WINDOW FRAME, A PACKED UNDERROOF COLLAR, AND A METHOD OF PROVIDING AN UNDERROOF COLLAR

(71) Applicant: VKR Holding A/S, Hørsholm (DK)

(72) Inventors: Bent Atzen, Skanderborg (DK); Jens-Ulrik Holst Henriksen, Aarhus V (DK); Lars Erdmann, Viby J (DK)

(73) Assignee: VKR Holding A/S

( * ) Notice: Subject to any disclaimer, the term of this patent is extended or adjusted under 35 U.S.C. 154(b) by 0 days.

(21) Appl. No.: 16/613,363

(22) PCT Filed: May 16, 2018

(86) PCT No.: PCT/EP2018/062754
§ 371 (c)(1),
(2) Date: Nov. 13, 2019

(87) PCT Pub. No.: WO2018/210937
PCT Pub. Date: Nov. 22, 2018

(65) Prior Publication Data

US 2020/0181912 A1 Jun. 11, 2020

(30) Foreign Application Priority Data

May 16, 2017 (DK) ..... PA 2017 70342

(51) Int. Cl.
*E04D 13/03* (2006.01)
*E04D 1/36* (2006.01)

(52) U.S. Cl.
CPC ..... *E04D 13/0305* (2013.01); *E04D 1/36* (2013.01)

(58) Field of Classification Search
CPC ..... E04D 13/0305; E04D 1/36; E04D 13/031; E04D 13/1475; E04D 13/03; E04D 13/147
See application file for complete search history.

(56) References Cited

FOREIGN PATENT DOCUMENTS

| | | |
|---|---|---|
| DE | 94313970 | 1/1996 |
| DE | 29908614 | 9/1999 |

(Continued)

OTHER PUBLICATIONS

Velux 2016 Product Catalog, Mar. 1, 2016, pp. 1 to 177.

(Continued)

*Primary Examiner* — Patrick J Maestri
(74) *Attorney, Agent, or Firm* — Merek, Blackmon & Voorhees, LLC

(57) ABSTRACT

An underroof collar for use in water-proofing the joint between a roof structure and a window frame is disclosed. It includes a plurality of collar members adapted for extending along frame member of the window frame, and each collar member includes an inner rim part and an outer skirt part intended for coming into engagement with the roof structure. The underroof collar is provided with at least one first engagement zone for positioning the underroof collar by bringing the first engagement zone into contact with a second engagement zone on another object, said first engagement zone being exposed in a packed state of the underroof collar. The first engagement zone may include a fastener and/or a cover layer. A packed underroof collar and a method for providing an underroof collar is also disclosed.

18 Claims, 8 Drawing Sheets

(56) References Cited

FOREIGN PATENT DOCUMENTS

| | | | | |
|---|---|---|---|---|
| EP | 0994992 | | 1/1999 | |
| EP | 2284329 | | 2/2011 | |
| EP | 2952646 | | 12/2015 | |
| WO | 95/28537 | | 10/1995 | |
| WO | 2006/002629 | | 1/2006 | |
| WO | WO-2006132558 | A1 * | 12/2006 | ..... E04D 13/1475 |

OTHER PUBLICATIONS

Velux 2014 Installer's Handbook, Fourth Edition Jan. 1, 2014, pp. 1 to 89.

International Search Report dated Aug. 24, 2018 issued in connection with International Application No. PCT/EP2018/062754, three pages.

International Preliminary Report on Patentability dated Jul. 25, 2019 issued in connection with International Applicatio No. PCT/EP2018/062754, fourteen pages.

* cited by examiner

Figure 1:
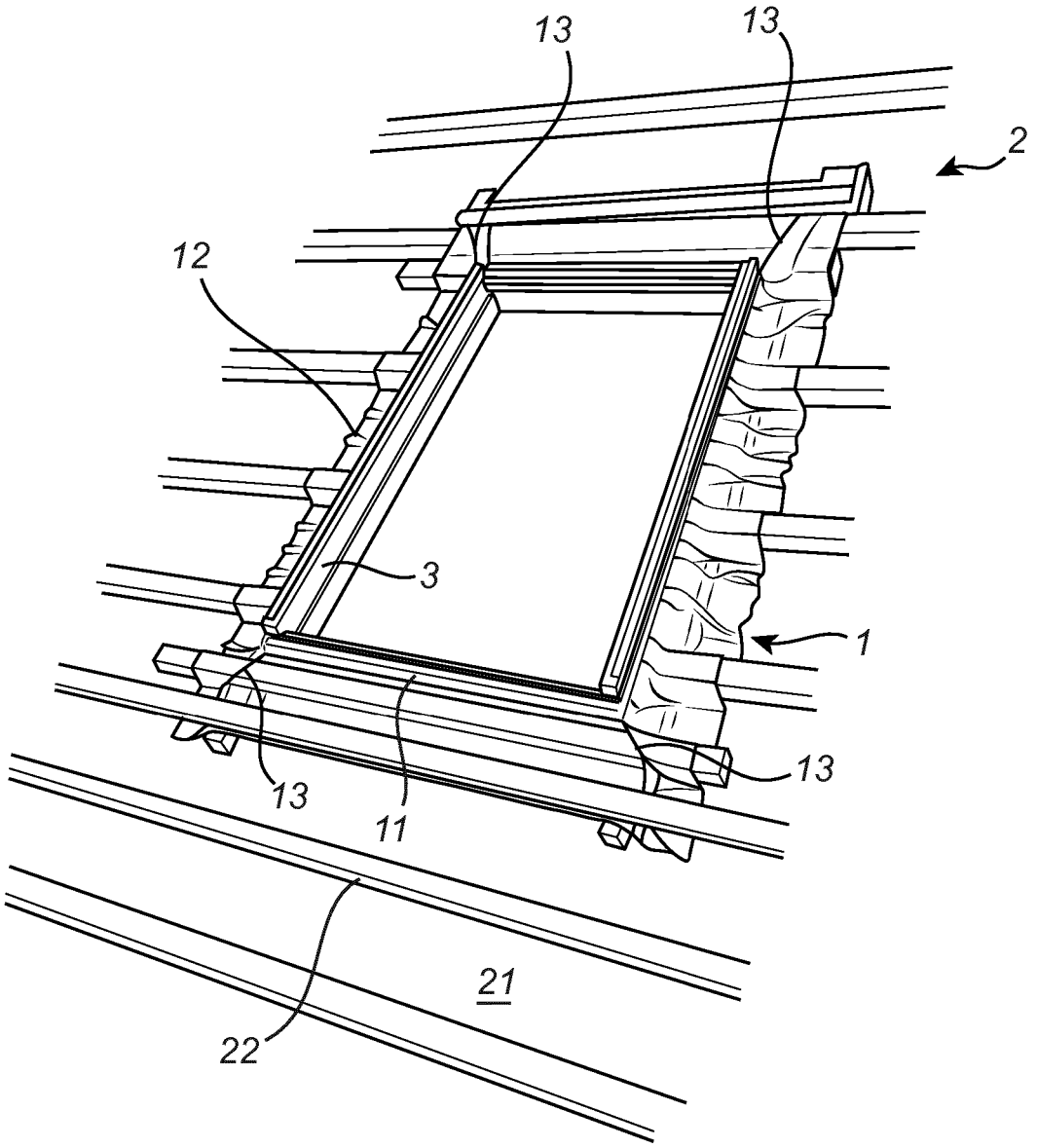

Prior art Fig. 1

UNDERROOF COLLAR FOR USE IN WATER-PROOFING THE JOINT BETWEEN A ROOF STRUCTURE AND A WINDOW FRAME, A PACKED UNDERROOF COLLAR, AND A METHOD OF PROVIDING AN UNDERROOF COLLAR

The present invention relates to an underroof collar made for use in water-proofing the joint between a roof structure and a window frame; said underroof collar comprising a top collar member, a bottom collar member, and two side collar members for extending along a top frame member, a bottom frame member, and two side frame members of a window frame, respectively, in a mounted state; each collar member including an inner rim part and an outer skirt part intended for coming into engagement with the roof structure; and said inner rim parts together delimiting a collar opening, at least in the mounted state. The invention further relates to a method of providing an underroof collar for use in water-proofing the joint between a roof structure and a window frame.

Underroof collars of this kind are known for example from EP0994992B1, EP2952646A1, and EP2284329A2.

These collars have proven to provide an excellent water-proofing of the joint between a roof structure and a window frame, but it remains a problem that the underroof collars are sometimes not mounted correctly which potentially leads to leaks which may damage the roof structure and/or the window as well as other parts of the building.

It is therefore an object of the invention to provide an underroof collar and a method of providing an underroof collar, which reduces the risk of errors during mounting.

In a first aspect of the invention this is achieved with an underroof collar, which is provided with at least one first engagement zone for positioning the underroof collar by bringing the first engagement zone into contact with a second engagement zone on another object, said first engagement zone being exposed in a packed state of the underroof collar.

By providing the underroof collar with a first engagement zone matching a corresponding second engagement zone on another object, which has a well-defined position in relation to the roof structure, the underroof collar too is positioned relatively precisely, thereby reducing the risk of erroneous mounting. The other object may be the window frame or another object associated with the installation of the roof window, such as an insulating frame or an installation aid or frame, such as a sealing collar.

By "first engagement zone" is meant a section of the underroof collar or an element attached thereto, which is specially adapted for being brought into contact with a second engagement zone and where an indication that this specific section is intended to serve as an engagement section is provided to the installer.

The first engagement zone may simply be a specific section of the underroof collar, which has been exposed and accentuated by packing the underroof collar so that a clear indication of this section being intended to serve as an engagement section is provided. The first engagement zone may have visually identifiable surface properties different from those of neighbouring sections of the underroof collar. Examples of visually identifiable surface properties include colour, texture, and pattern. In case an attached element defines the first engagement zone, the attached element may be made from a different material than the underroof collar.

An element attached to the underroof collar and defining the first engagement zone, may for example be an adhesive or other fastener, as will be described in detail below. Another example is a piece of material, such as a sheet polymer, intended to be left on the underroof collar and being brought into contact with the second engagement zone. Such an additional element may be of the same size and shape as the second engagement zone so that an alignment of the edges of the additional element with the edges of the secand engagement zones indicates a correct positioning of the underroof collar.

It is noted that some prior art underroof collars include one or more fasteners extending or distributed along the entire inner rim. Such fastener(s) may form part of the first engagement zone, but the first engagement should still be clearly distinguishable from the rest of the underroof collar.

"Second engagement zone" is intended to mean a section of material suitable for engagement with the first engagement zone in a manner entailing an intended positioning of the underroof collar. An indication of the second engagement zone being intended for engagement with the first engagement zone is not required, but may be advantageous. Information about the position of the second engagement zone is preferably provided on the underroof collar, for example on or at the first engagement zone.

The term "engagement" does not necessarily entail an interconnection. A mere contact may be enough if the underroof collar is then kept in place by friction or gravity.

The term "positioning" is intended to mean that when the first engagement zone is engaged with the second engagement zone, at least a section of the underroof collar is arranged in its intended permanent relation to the other object. If the other object is a window frame already mounted correctly in the roof structure, the underroof collar will also be correctly positioned in relation to the roof structure. If the other object is an associated item, such as an insulating frame or a sealing collar, the underroof collar will be correctly positioned in relation to the roof structure by arranging the other object correctly.

One or both engagement zones may include a cover layer serving as an indication of the engagement zone and/or protecting the underroof collar during handling and/or transportation. The cover layer may be a simple sheet of material, made for example from paper or a polymer, but more complex designs are possible, including the use of other items associated with the installation of the roof window in the roof structure as a covering for the engagement zone. For example, a flashing element or a bag or box containing accessories to be used during the installation may be temporarily connected to the underroof collar in order to cover the first engagement zone.

As opposed to the additional element described above, which is attached to the underroof collar and defining the first engagement zone, the cover layer is intended for being removed before bringing the first and second engagement zones into contact with each other.

One or both engagement zones may include at least one fastener, such as for example an adhesive. It is also possible to use snap-connectors, hook-and-loop type connectors or the like, with a male part on the first engagement zone and female part on the second engagement zone or vice versa. A cover layer may protect the fastener during handling and/or transportation. If using a two-part fastener, the part intended to serve as the second engagement zone may be attached to the part serving as the first engagement zone in a state of delivery of the underroof collar, such serving as a cover layer. When at the installation site, the part intended to serve as the second engagement zone is detached from the part serving as the first engagement zone and applied to the other object, to which the underroof collar is to be connected, so that the two parts may be reconnected as part of the installation process.

Additional fasteners may be provided at the inner rim of at least one collar member for attachment to the window frame as is well known from the prior art.

One or both engagement zones may include information about the intended use of the underroof collar. This may include merely an indication of the intended positioning of the underroof collar or more detailed information, for example regarding how to unpack the underroof collar. Such information may also be printed on a cover layer covering at the first engagement zone. Information regarding the intended positioning of the underroof collar printed directly on the material of the underroof collar may potentially define the engagement zone.

In the packed state of delivery of the underroof collar may include at least one fixation for keeping the underroof collar in the packed state. Examples of such fixations are strings, straps, clips, staples, hook-an-loop type fasteners, adhesive tape, adhesive, and/or glue.

In one embodiment, the packed underroof collar has a length corresponding substantially to the length of the top frame member of the window frame with which the underroof collar is intended to be used. This is particularly advantageous when the second engagement zone is provided on the top frame member of the window frame as the packed underroof collar may then easily be aligned with the top frame member during mounting. Furthermore, it is then well suited for being provided in the same packaging as other items associated with the installation of a roof window, such as for example a top frame covering provided for use in weather-proofing the top frame member of the window frame, said space fitting over the top frame member of the window frame in the mounted state. In one embodiment, the underroof collar is arranged in a space delimited by a top frame covering in the state of delivery. In this case the top frame covering may serve as a fixation for keeping the underroof collar in the packed state as described above.

In one embodiment, the underroof collar is attached to at least one insulating member of an insulating frame, said insulating member possibly but not necessarily defining the first engagement zone. This means that the underroof collar and the insulating member, or possibly the entire insulating frame may be provided as one integrated product.

In yet another embodiment, the underroof collar is attached to a sealing collar adapted for being mounted around a window frame mounted in an inclined roof of a building, said sealing collar comprising an inner portion having top, bottom and side members, where said inner portion has an inner edge and an outer edge opposite the inner edge, where said inner edge defines an opening when the sealing collar is in the mounted condition, where said inner portion is adapted for surrounding a window frame by the inner edge, where the top, bottom and side members of the inner portion are made from a substantially dimensionally stable material, where the shape and size of the opening substantially matches the shape and size of the window frame, when the sealing collar is in the mounted condition, and where the underroof collar is attached to a member of the inner portion. The sealing collar thus serves as a carrier for the underroof collar so that they can be supplied and handled as one integrated product. The underroof collar may be provided in such a position on the sealing collar that the first engagement zone is automatically brought into engagement with the second engagement zone when installing the sealing collar correctly. It will, however, often be preferred to position the underroof collar at a distance from its intended final position so as to make room for installation steps, which need to be performed before applying the underroof collar.

To facilitate unpacking, the underroof collar may be provided in a rolled-up state. Sections of the underroof collar may be folded over others before or after rolling it in order to get the packed underroof collar down to a manageable size.

The underroof collar is preferably made from a textile-like waterproof membrane, such as for example a non-woven, as is well known in prior art underroof collars.

In a traditional underroof collar, the size and shape of the collar opening matches the outer size and shape of the window frame, possibly including any insulating members arranged at its outer sides. If attached to a sealing collar, the collar opening may be larger as the sealing collar may bridge a gap between the window frame and the inner rim of the underroof collar.

Another aspect of the invention relates to a method of providing an underroof collar for use in water-proofing the joint between a roof structure and a window frame, comprising the following steps, where the order of steps B) and C) may be reversed:

A) providing an underroof collar comprising a top collar member, a bottom collar member, and two side collar members for extending along a top frame member, a bottom frame member, and two side frame members of a window frame, respectively, in a mounted state, each collar member including an inner rim part and an outer skirt part intended for coming into engagement with the roof structure, said inner rim parts together delimiting a collar opening, at least in the mounted state, and said inner rim of at least one collar member comprising at least one fastener for attachment to the window frame, B) packing the underroof collar by rolling and/or folding, and C) providing the underroof collar with at least one first engagement zone for positioning the underroof collar to another object, said first engagement zone being exposed in a packed state of delivery of the underroof collar and adapted for contact with a second engagement zone on another object.

By providing the underroof with a clearly defined first engagement zone matching a second engagement zone on another object the risk of erroneous mounting is considerably reduced.

In one embodiment the method further includes the following steps:

D) arranging the packed underroof collar at a window frame mounted in a roof structure, thereby bringing the first engagement zone into contact with a second engagement zone on another object, and E) unpacking the underroof collar and arranging it so that the collar opening surrounds the window frame.

First arranging the packed underroof collar with the first engagement zone in contact with a second engagement zone and then arranging it so that the collar opening surrounds the window frame makes the installation process easier compared to the installation of a traditional underroof collar. A particular advantage is that the unpacking, where the underroof collar may easily be caught by wind, is only performed once the first and second engagement zones have been brought into contact.

The embodiments of the invention described with reference to the first aspect of the invention also applies to this one and vice versa unless otherwise stated.

Figure 2:
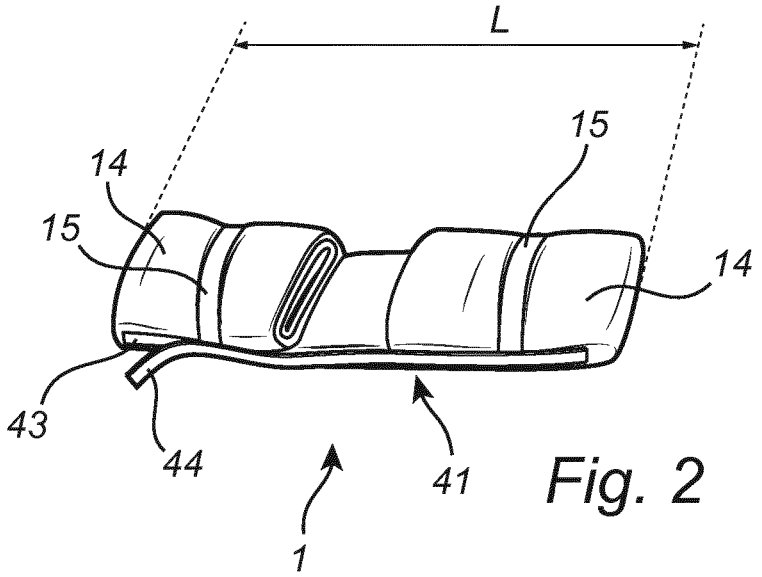
Figure 3:
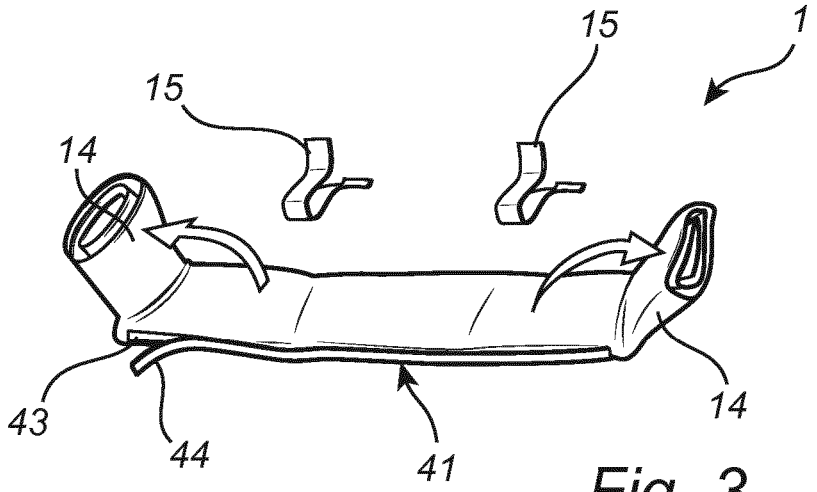
Figure 4:
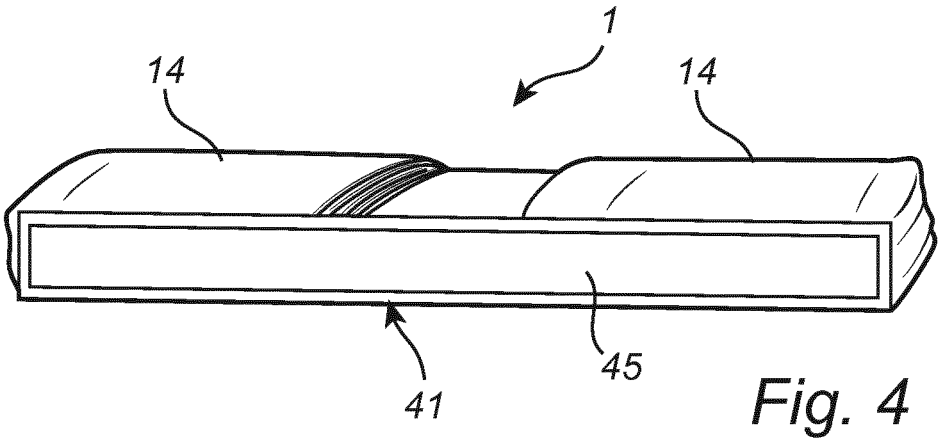
Figure 5:
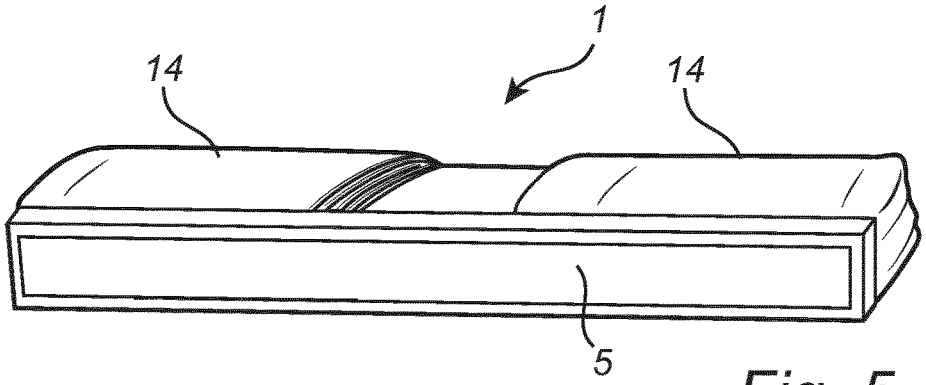
Figure 6:
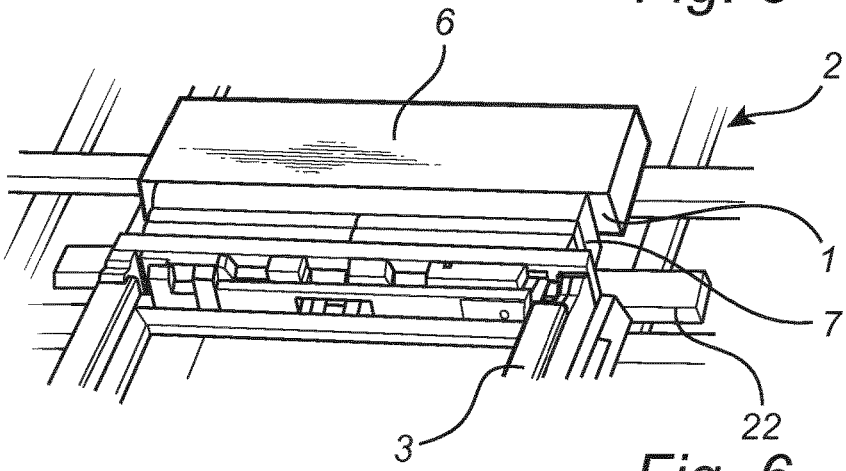
Figure 7:
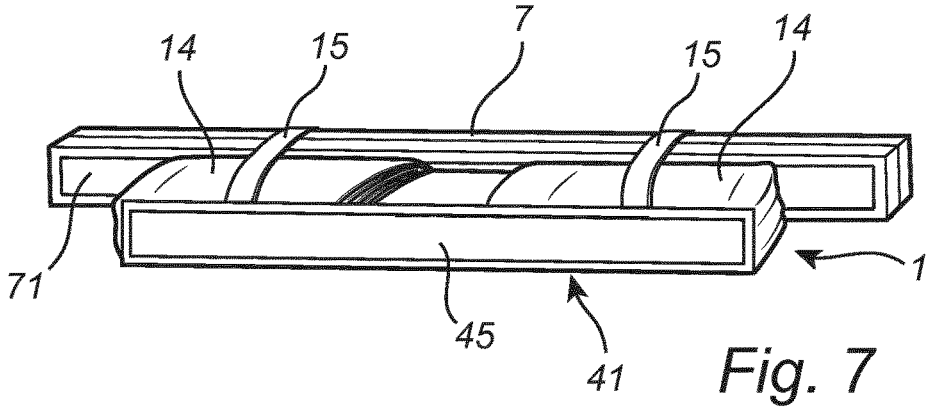
Figure 8:
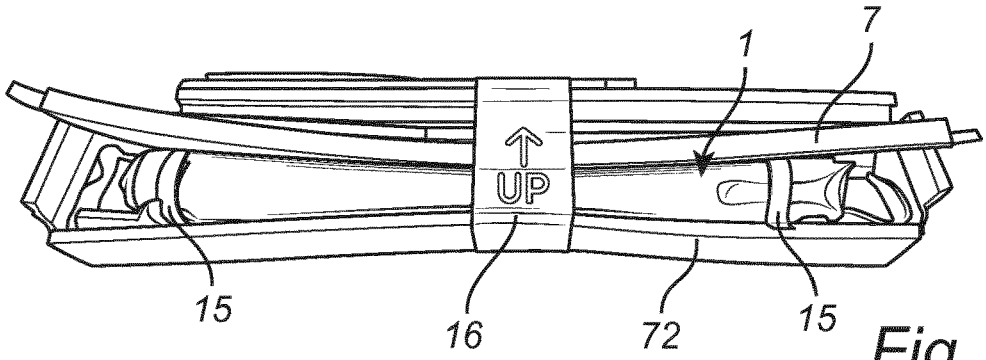
Figure 9:
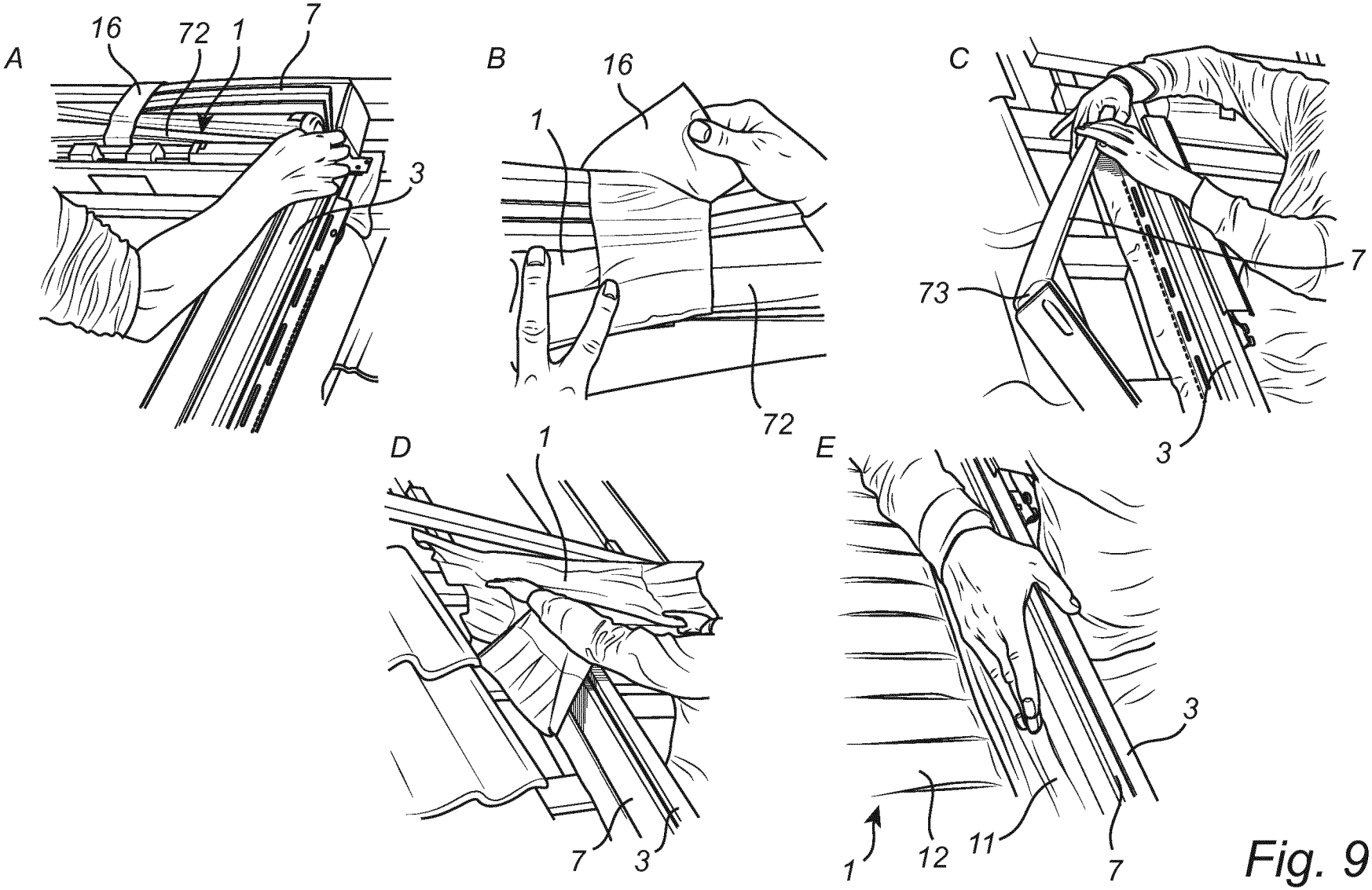
Figure 10:
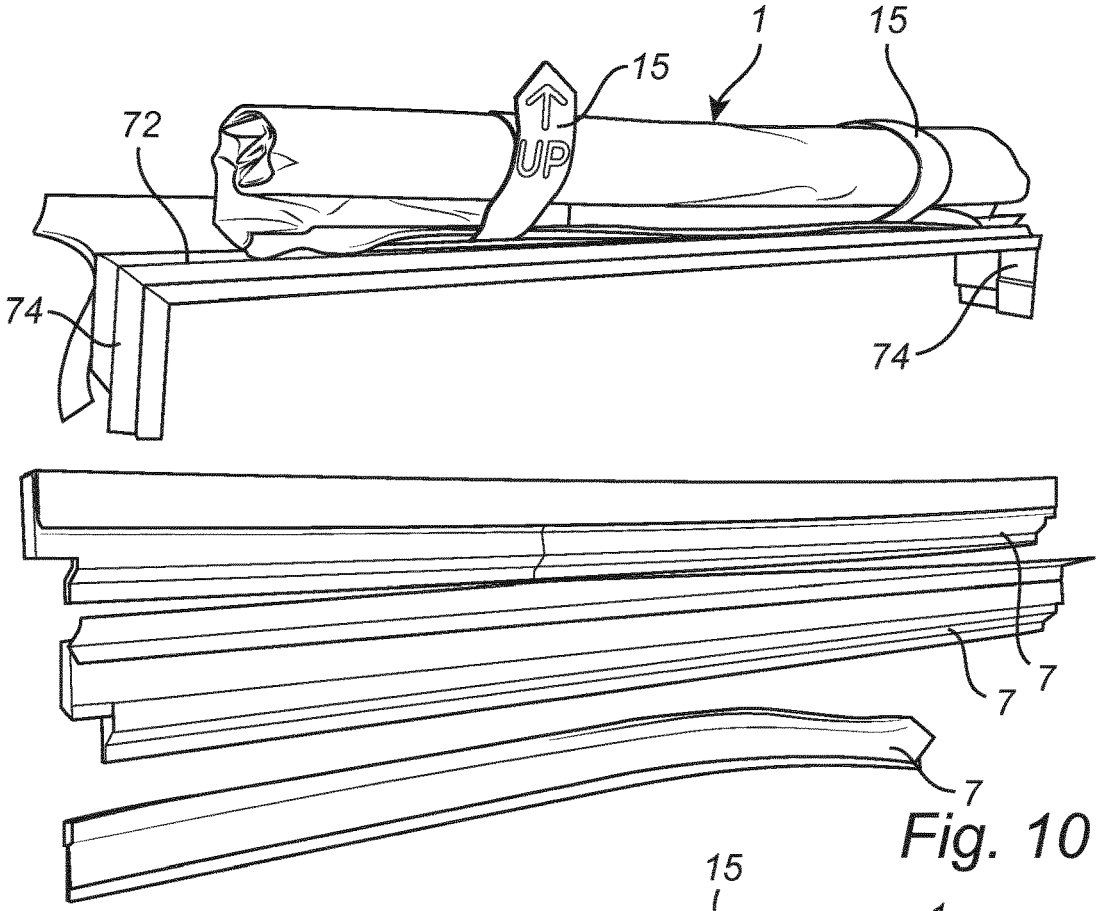
Figure 11:
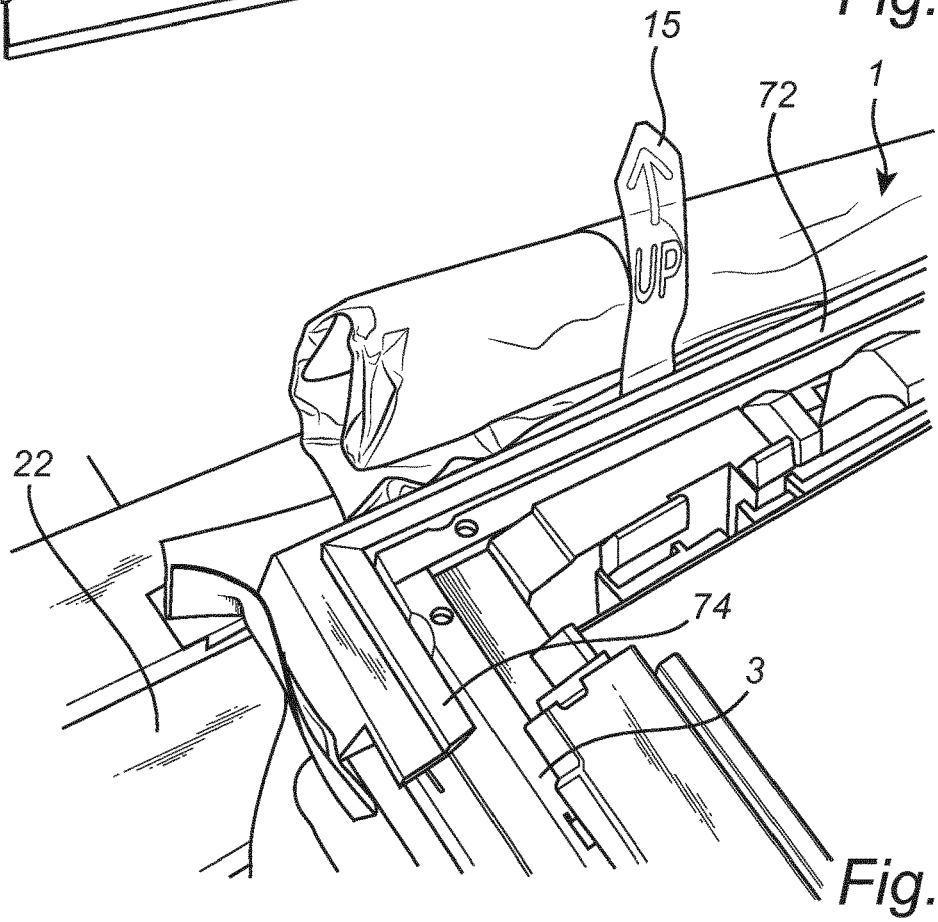
Figure 12:
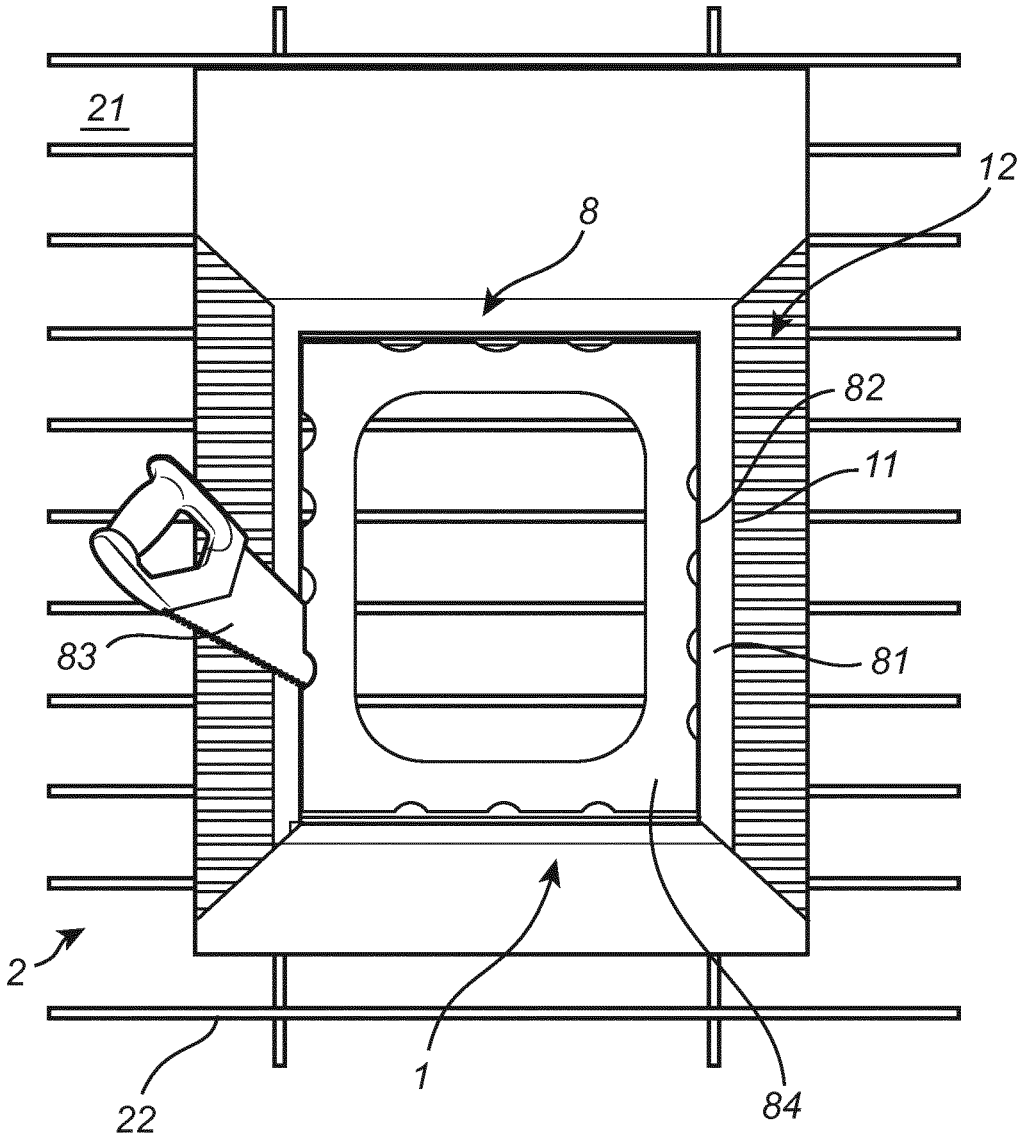
Figure 13:
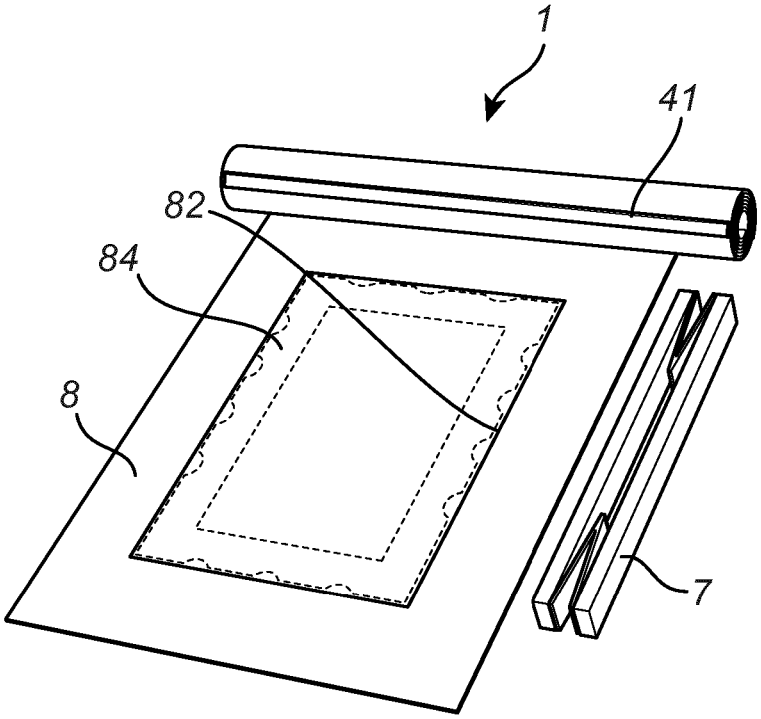
Figure 14:
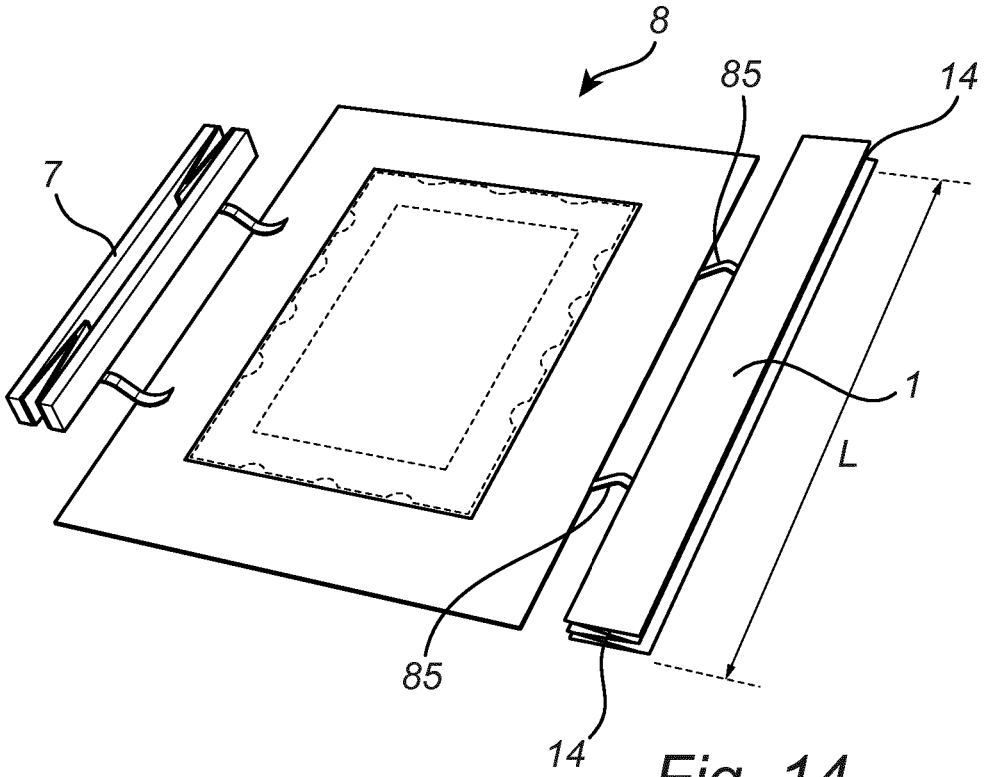
Figure 15:
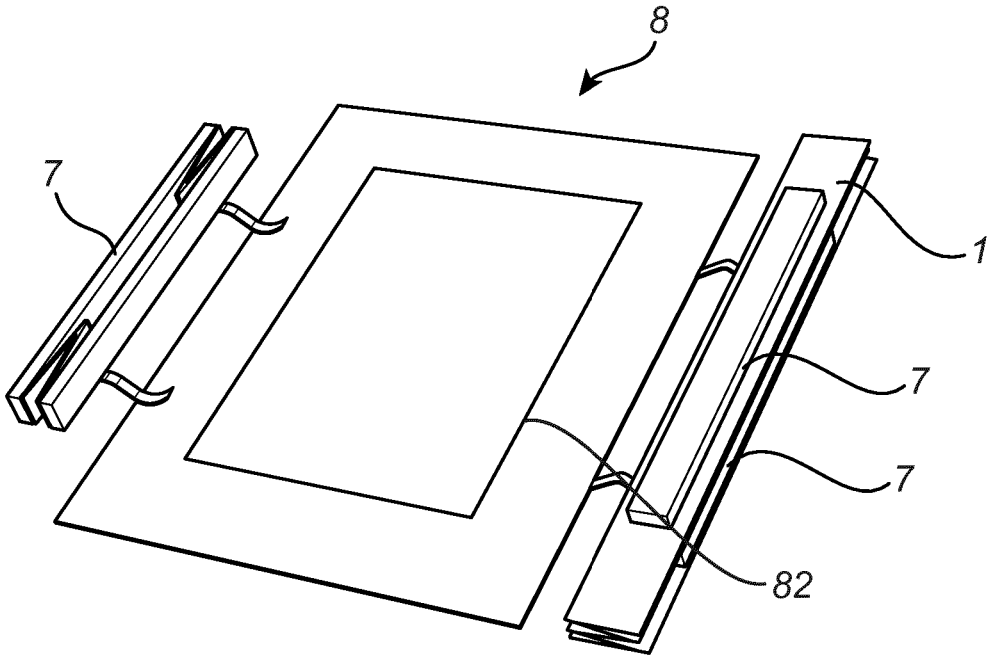

In the following the invention will be described in more detail with reference to the drawing, where:

FIG. 1 is a perspective sketch of a window frame mounted in an inclined roof structure and with an underroof collar, FIG. 2 is a perspective sketch of a first embodiment of a packed underroof collar, FIG. 3 illustrates the unpacking of the underroof collar in FIG. 2, FIG. 4 is a perspective sketch of a second embodiment of a packed underroof collar, FIG. 5 is a perspective sketch of a third embodiment of a packed underroof collar, FIG. 6 is a perspective sketch of a fourth embodiment of a packed underroof collar, FIG. 7 is a perspective sketch of a fifth embodiment of a packed underroof collar, FIG. 8 is a perspective sketch of a sixth embodiment of a packed underroof collar, FIG. 9 illustrates the installation of the underroof collar in FIG. 8, FIG. 10 is a perspective sketch of a seventh embodiment of a packed underroof collar, FIG. 11 shows the packed underroof collar in FIG. 10 in a mounted state, FIG. 12 is a sketch of a sealing collar provided on an inclined roof structure during preparation for the installation of a roof window and with an unpacked underroof collar attached to the sealing collar, FIG. 13 is a sketch of a sealing collar of the type shown in FIG. 12 supporting a packed underroof collar and insulation members, FIG. 14 corresponds to FIG. 13 but showing a different embodiment of the packed underroof collar and insulation members, and FIG. 15 corresponds to FIGS. 13 and 14 but showing yet another embodiment of the packed underroof collar and insulation members.

FIG. 1 shows an embodiment of the underroof collar 1 installed on a roof 1, here represented by and underroof 21 and laths 22, and surrounding a window frame 3.

A prior art underroof collar 1 bridging the joint between an inclined roof structure 2, here represented by an underroof 21 and laths 22, and a window frame 3 is shown in FIG. 1. Such underroof collars include an inner rim 11, which defines a collar opening matching the size and shape of the outer side of the window frame, and a skirt part 12 adapted for coming into contact with the exterior side of the underroof 21, as is well known to the skilled person.

The underroof collar 1 is composed of a top collar member, a bottom collar member, and two side collar members extending along a top frame member, a bottom frame member, and two side frame members of a window frame, respectively. The four collar members are here interconnected at seams 13 extending at 45 degrees to the length direction of the side collar members, but other embodiments are possible and the collar members may also be formed from a single piece of material.

Different embodiments of underroof collars will be described with reference to FIGS. 3-10 and it is to be understood that unless otherwise stated these underroof collars are of the same basic constitution as the one in FIG. 1, i.e. including an inner rim defining a collar opening and a skirt part adapted for coming into contact with the exterior side of the underroof.

The same reference numbers have been used in all figures of the drawing for features having substantially the same function even though they are not necessarily identical.

FIG. 2 shows a packed underroof collar 1, where it has first been rolled, then the ends 14 have been folded over the centre of the roll, and then the underroof collar has been fixated in the rolled and folded state by means of straps 15. A first engagement zone 41 is found on an exposed side of the roll extending from one fold to the other. In this embodiment the first engagement zone includes a fastener in the form of a strip of adhesive 43 covered by a cover layer 44. As indicated on the left-hand side of the figure, the cover layer may be peeled off in order to expose the fastener before bringing the first engagement zone in contact with a second engagement zone (not shown).

In this embodiment the underroof collar 1 is rolled in a direction parallel to the side collar members so that it advances in the direction of inclination of the roof structure when it is unrolled. The ends 14 are folded such that the length L of the packed underroof collar corresponds substantially to the width of the window frame (not shown), i.e. to the length of the top and bottom frame members. This means that the packed underroof collar may be easily aligned with the window frame during mounting, and that this embodiment is well suited for use with a second engagement zone on the top or bottom frame member.

FIG. 3 shows the unpacking of the underroof collar 1 of FIG. 2. After having brought the first engagement zone into contact with a second engagement zone, the straps 15 are removed and then the ends 14 are unfolded as indicated by the arrows. The underroof collar is now ready for being unrolled and thanks to the engagement between the first and second engagement zones the installer does not have to handle a loose underroof collar, thereby making the installation process less sensitive to wind. When the packed underroof collar is aligned with the top or bottom frame member, the unrolling will result in the side collar members becoming aligned with the side frame members and the underroof then only needs to be pulled down over the window frame.

FIG. 4 shows another embodiment of the underroof collar 1, which has been rolled and folded in the same way as described with reference to FIGS. 2 and 3. Here the first engagement zone 41 is in the form of a piece of sheet plastic 45 attached to an exposed side of the rolled and folded underroof collar by means of an adhesive. This adhesive attachment also serves as a fixation keeping the folded ends 14 in place, so that there is no need for straps.

The sheet plastic 45 has the same size and shape as the part of the top frame member of the window frame (not shown) extending above the roof surface in the mounted state. This means that when using the outer surface of the top frame member, i.e. the surface facing away from the frame opening delimited by the frame members, as a second engagement zone, it will be clearly visible if the first and second engagement zones have not been correctly aligned. The sheet plastic 45 may be provided with information regarding the intended use and method of installation of the underroof collar. As an example the text "Align with frame top member" may be printed on the sheet plastic.

The sheet plastic 45 may be made from any suitable polymer, and other materials such as cardboard or plywood may also be used. Care should, however, be taken that the material is suitable for being left in the roof structure.

FIG. 5 shows an embodiment, where the underroof collar is attached to a box 5 containing other items to be used for example in connection with the installation of the roof window, the underroof collar, an insulating frame, or a flashing. The box serves as a cover layer covering a fastener of the first engagement zone (not visible) and further keeps the folded ends in place as described with reference to the sheet plastic above.

Here too, the underroof collar 1 has been rolled and folded in the same way as described with reference to FIGS. 2 and 3, but it is to be understood that the underroof collar may be packed in a different way, for example folding before rolling or only by folding. This applies to the other embodiments as well.

The underroof collar may also be arranged in a box (not shown) in the packed state, or in a space delimited by a top frame covering 6 as shown in FIG. 6 where the top frame covering has been temporarily placed on the roof structure 2 above an already installed window frame 3 together with a set of insulation members 7.

FIG. 7 shows an embodiment corresponding substantially to that in FIG. 4, but where insulation members 7 adapted for use along outer surfaces of frame members of the window frame (not shown) has been attached to packed underroof collar 1 by means of straps 15. Typically, the straps will be loosened and the insulation members mounted before bringing the first and second engagement zones into contact with each other. If the insulation members are adapted for the formation of an insulating frame extending all the way around the window frame, the second engagement zone can be provided on an outer surface of one or more insulation members. In this embodiment, the insulation members are provided with indications of zones 71 intended for engagement with the window frame, corresponding the first engagement zone 41 of the underroof collar.

FIG. 8 shows another embodiment, where the underroof collar 1 is enclosed by insulation members 7. The underroof collar 1 is kept in its packed state, where it has first been folded and then rolled, by strips of tape 15 and the entire package consisting of the underroof collar 1 and insulation members 7 is fixated by a third piece of tape 16. This third piece of tape is provided with the indication "UP" telling the installer how to turn the package during installation. The underroof collar 1 is attached to the insulation member 72, which is intended to be arranged against the outer surface of the top frame member of the window frame in the mounted state, and this insulation member 72 thus serves as the first engagement zone.

FIG. 9 shows how the underroof collar 1 in FIG. 8 is installed. In image A the package comprising the underroof collar and the insulation members is arranged so that one insulation member 72 abuts the outer side of the top frame member of the window frame. In image B the third strip of tape 16 is removed. In image C the remaining insulation members 7, which are linked to the one arranged at the top frame member of the window frame and to each other by film hinges 73, are arranged to extend along the side frame members of the window frame. In image D the underroof collar 1 is unrolled and unfolded. In image E the inner rim of the underroof collar is attached to the outer side of the insulation member 7 by means of a pressure sensitive adhesive on the inner side of the underroof collar. It may also be attached directly to the window frame 3 or kept in place simply by friction caused by compression of the insulation members occurring when the underroof collar is pulled down over the window frame and the insulation members. As may be seen, the underroof collar 1 is here of a textile like material and the skirt part 12 is pleated in order to be able to expand and engage both with laths and the underroof between the laths. This may be the case in the other embodiments too.

FIGS. 10 and 11 show an embodiment resembling that in FIGS. 8 and 9. Here the insulation members are not interconnected and the insulation member 72 carrying the underroof collar 1 and serving as the first engagement zone is provided with corner pieces ensuring a correct positioning of the insulation member and the underroof collar in relation to the window frame. Moreover, the indication of direction is provided on one of the two strips of tape 15 fixating the underroof collar in its rolled-up state rather than on a separate strip.

FIG. 12 shows an alternative embodiment, where the underroof collar is not connected to the window frame (not shown) or an insulation member attached thereto but to an installation aid in the form of a sealing collar 8 surrounding a window frame in the mounted state. At least an inner portion 81 of the sealing collar 8 is are made from a substantially dimensionally stable material, and an inner edge 82 of the sealing collar is used as a cutting guide when making the opening in the roof structure 2 intended to receive the window frame, here illustrated by a saw 83 following the inner edge 82. The sealing collar 8 further comprises a stabilizing portion 84 attached to the inner edge 13 of the inner portion 11 at a plurality of points, whereby the inner portion 11 is urged to maintain its desired dimensions.

FIG. 13 shows the embodiment in FIG. 12 with the underroof collar 1 still in its packed state. The packed underroof collar 1 is attached to the sealing collar 8 in position well above the opening formed by the inner edge 82, thus providing room for the installation of the window frame (not shown) and the insulation members 7, which are also carried by the sealing collar. When ready for installing the underroof collar 1, it is rolled down onto the sealing collar so that the first engagement zone 41 on the underroof collar comes into contact with the exterior surface of the sealing collar, said exterior surface thus serving as the second engagement zone. It is, however, also possible to have a/the second engagement zone on the window frame or on the insulation.

FIG. 14 shows an embodiment where the underroof collar 1 is not rolled but folded onto itself and attached to the sealing collar 8 by means of straps 84. The underroof collar is kept in its folded state by glue dots or spot welds (not visible). Insulating elements 7 are attached to the sealing collar in the same way. As may be seen, the length L of the packed underroof collar is considerably longer than the sealing collar and hence also the window frame (not shown), since it is only folded in one direction. In this embodiment too, it will be possible to fold the end sections in order to make it easier to handle the packed underroof collar and the sealing collar unit to which it is attached.

FIG. 15 shows yet another embodiment with a the sealing collar 8. Here insulation members 7 are attached both to the sealing collar and to the underroof collar 1, but otherwise the underroof collar corresponds to that in FIG. 14. Furthermore, the sealing collar has no stabilizing portion.

The features of the embodiments described above may be combined into several other embodiments falling with scope of the claims.

The invention claimed is:

1. An underroof collar for use in water-proofing the joint between a roof structure and a window frame, said underroof collar comprising a top collar member, a bottom collar member, and two side collar members for extending along a top frame member, a bottom frame member, and two side frame members of a window frame, respectively, in a mounted state, each collar member including an inner rim part and an outer skirt part intended for coming into engagement with the roof structure, and said inner rim parts together delimiting a collar opening, at least in the mounted state, the underroof collar is provided with at least one first engagement zone for positioning the underroof collar by bringing the first engagement zone into contact with a second engagement zone on another object, said first engagement zone being exposed in a packed state of the underroof collar and where the underroof collar is attached to at least one insulating member of an insulating frame.

2. The underroof collar according to claim 1, where at least one engagement zone includes a cover layer.

3. The underroof collar according to claim 1, where at least one engagement zone includes at least one fastener.

4. The underroof collar according to claim 1, where at least one engagement zone includes information about the intended use of the underroof collar.

5. A packed underroof collar, comprising:

an underroof collar having a top collar member, a bottom collar member, and two side collar members for extending along a top frame member, a bottom frame member, and two side frame members of a window frame, respectively, in a mounted state, each collar member including an inner rim part and an outer skirt part intended for coming into engagement with the roof structure, said inner rim parts together delimiting a collar opening, at least in the mounted state, the underroof collar is provided with at least one first engagement zone for positioning the underroof collar by bringing the first engagement zone into contact with a second engagement zone on another object, said first engagement zone being exposed in a packed state of the underroof collar and where the underroof collar is attached to at least one insulating member of an insulating frame; and, at least one fixation for keeping the underroof collar in the packed state.

6. The underroof collar according to claim 1 wherein the underroof collar has a length corresponding substantially to the length of the top frame member of the window frame with which the underroof collar is intended to be used when the underroof collar is in the packed state.

7. The packed underroof collar according to claim 5, where in a state of delivery the underroof collar is arranged in a space delimited by a top frame covering, said top frame covering being provided for use in weather-proofing the top frame member of the window frame, said space being intended for fitting over the top frame member of the window frame in the mounted state.

8. The packed underroof collar according to claim 5, where the underroof collar is attached to a sealing collar adapted for being mounted around a window frame mounted in an inclined roof of a building, said sealing collar comprising an inner portion having top, bottom and side members, where said inner portion has an inner edge and an outer edge opposite the inner edge, where said inner edge defines an opening when the sealing collar is in the mounted condition, where said inner portion is adapted for surrounding a window frame by the inner edge, where the top, bottom and side members of the inner portion are made from a substantially dimensionally stable material, where shape and size of the opening substantially matches the shape and size of the window frame, when the sealing collar is in the mounted condition, and where the underroof collar is attached to a member of the inner portion.

9. The A packed underroof collar according to claim 5, where the underroof collar is in a rolled-up state.

10. A method of providing an underroof collar for use in water-proofing the joint between a roof structure and a window frame, comprising the following steps, where the order of steps B) and C) may be reversed:

A) providing an underroof collar comprising a top collar member, a bottom collar member, and two side collar members for extending along a top frame member, a bottom frame member, and two side frame members of a window frame, respectively, in a mounted state, each collar member including an inner rim part and an outer skirt part intended for coming into engagement with the roof structure, and said inner rim parts together delimiting a collar opening, at least in the mounted state, B) packing the underroof collar by rolling and/or folding, and C) providing the underroof collar with at least one first engagement zone for positioning the underroof collar to another object, said first engagement zone being exposed in a packed state of delivery of the underroof collar and adapted for contact with a second engagement zone on another object and where the underroof collar is attached to at least one insulating member of an insulating frame.

11. A method according to claim 10, further including the following steps:

D) arranging the packed underroof collar at a window frame mounted in a roof structure, thereby bringing the first engagement zone into contact with a second engagement zone on another object, and E) unpacking the underroof collar and arranging it so that the collar opening surrounds the window frame.

12. The underroof collar according to claim 2, where at least one engagement zone includes at least one fastener.

13. The underroof collar according to claim 1, where in a state of delivery the underroof collar is arranged in a space delimited by a top frame covering, said top frame covering being provided for use in weather-proofing the top frame member of the window frame, said space being intended for fitting over the top frame member of the window frame in the mounted state.

14. The underroof collar according to claim 1, where the underroof collar is attached to a sealing collar adapted for being mounted around a window frame mounted in an inclined roof of a building, said sealing collar comprising an inner portion having top, bottom and side members, where said inner portion has an inner edge and an outer edge opposite the inner edge, where said inner edge defines an opening when the sealing collar is in the mounted condition, where said inner portion is adapted for surrounding a window frame by the inner edge, where the top, bottom and side members of the inner portion are made from a substantially dimensionally stable material, where shape and size of the opening substantially matches the shape and size of the window frame, when the sealing collar is in the mounted condition, and where the underroof collar is attached to a member of the inner portion.

15. The underroof collar according to claim 2 wherein the underroof collar has a length corresponding substantially to the length of the top frame member of the window frame with which the underroof collar is intended to be used when the underroof collar is in the packed state.

16. The underroof collar according to claim 3 wherein the underroof collar has a length corresponding substantially to the length of the top frame member of the window frame with which the underroof collar is intended to be used when the underroof collar is in the packed state.

17. The underroof collar according to claim 4 wherein the underroof collar has a length corresponding substantially to the length of the top frame member of the window frame with which the underroof collar is intended to be used when the underroof collar is in the packed state.

18. The packed underroof collar according to claim 5 wherein the underroof collar has a length corresponding substantially to the length of the top frame member of the window frame with which the underroof collar is intended to be used when the underroof collar is in the packed state.

* * * * *